US008919581B2

(12) United States Patent
Ray

(10) Patent No.: US 8,919,581 B2
(45) Date of Patent: Dec. 30, 2014

(54) MERCHANDISE DISPLAY STAND WITH LOCKING SHELVES

(75) Inventor: Jason Patrick Ray, Murfreesboro, TN (US)

(73) Assignee: US Display Group, Inc., Tullahoma, TN (US)

( * ) Notice: Subject to any disclaimer, the term of this patent is extended or adjusted under 35 U.S.C. 154(b) by 0 days.

(21) Appl. No.: 13/547,662

(22) Filed: Jul. 12, 2012

(65) Prior Publication Data

US 2014/0014602 A1 Jan. 16, 2014

(51) Int. Cl.

| | |
|---|---|
| ***A47F 3/14*** | (2006.01) |
| ***A47J 47/00*** | (2006.01) |
| ***A47G 29/00*** | (2006.01) |

(52) U.S. Cl.

USPC ..... 211/73; 211/132.1

(58) Field of Classification Search

CPC ..... A47F 5/116; A47F 5/114; A47F 5/112; A43B 43/02; A43B 43/027; G09F 1/06; B65D 25/06

USPC ..... 211/72, 73, 70.1, 49.1, 11, 132.1, 45, 211/135, 90.04, 195, 149; 248/459, 174, 248/150

See application file for complete search history.

(56) References Cited

U.S. PATENT DOCUMENTS

| | | | | | |
|---|---|---|---|---|---|
| 1,519,207 | A | * | 12/1924 | Kay | 108/101 |
| 2,062,165 | A | * | 11/1936 | Davidson | 211/135 |
| 2,063,393 | A | * | 12/1936 | McIver | 211/49.1 |
| 2,135,093 | A | * | 11/1938 | Abrams | 248/152 |
| 2,466,599 | A | * | 4/1949 | Larkin | 40/124.09 |
| 2,595,002 | A | * | 4/1952 | Schneider | 108/101 |
| 2,663,104 | A | * | 12/1953 | Hoagland | 40/124.01 |
| 2,936,145 | A | * | 5/1960 | Woelky | 248/174 |
| 2,949,192 | A | * | 8/1960 | Maliff | 211/49.1 |
| RE25,309 | E | * | 1/1963 | Adams | 248/174 |
| 3,079,062 | A | * | 2/1963 | Craddock et al. | 229/116 |
| 3,141,555 | A | * | 7/1964 | Funke et al. | 211/135 |
| 3,292,796 | A | * | 12/1966 | Paige | 211/132.1 |
| 3,401,993 | A | * | 9/1968 | Fenkel | 312/111 |
| 3,721,413 | A | * | 3/1973 | Robinson | 248/174 |
| 3,836,104 | A | | 9/1974 | Miller et al. | |
| 4,026,220 | A | * | 5/1977 | Schuring, Jr. | 108/101 |
| 4,262,439 | A | * | 4/1981 | Dinan et al. | 40/606.03 |
| 4,289,245 | A | * | 9/1981 | Hasulak | 211/133.4 |
| 4,384,651 | A | * | 5/1983 | Smith | 211/132.1 |
| 4,411,382 | A | * | 10/1983 | Taub | 229/100 |
| 4,506,790 | A | * | 3/1985 | Muscari | 211/59.4 |
| 4,512,541 | A | * | 4/1985 | Lietzke | 248/459 |
| 4,523,675 | A | * | 6/1985 | Schroter | 206/764 |
| 4,550,837 | A | * | 11/1985 | Simmons | 211/128.1 |
| 4,582,283 | A | * | 4/1986 | Schmitt | 248/174 |
| D286,960 | S | * | 12/1986 | Taub | D6/475 |
| 4,678,089 | A | * | 7/1987 | Lang | 211/133.4 |
| 4,911,311 | A | * | 3/1990 | Nagai | 211/126.16 |
| 4,964,520 | A | * | 10/1990 | Kilmartin, III | 211/131.1 |

(Continued)

*Primary Examiner* — Joshua Rodden
*Assistant Examiner* — Kimberley S Wright

(57) ABSTRACT

A merchandise display stand for floor display having a support portion and trays. The support portion having a base member integral with and at about a right angle to a dovetail back member. One or more trays arranged on the support portion. The trays having a dovetail slot to accommodate the dovetail back member of the support portion. One or more trays is lowered into position onto the support portion such that the dovetail projection back member fits within the dovetail slot of the tray locking the tray onto the back member.

15 Claims, 9 Drawing Sheets

(56) References Cited

U.S. PATENT DOCUMENTS

| | | | | | |
|---|---|---|---|---|---|
| 4,991,804 | A | * | 2/1991 | Iannucci | 248/174 |
| 5,000,329 | A | * | 3/1991 | Luberto | 211/132.1 |
| 5,183,166 | A | * | 2/1993 | Belokin et al. | 211/149 |
| 5,230,423 | A | * | 7/1993 | Gellatly | 206/764 |
| 5,259,578 | A | * | 11/1993 | Jones et al. | 248/174 |
| 5,271,515 | A | * | 12/1993 | Berkheimer et al. | 220/4.27 |
| 5,273,169 | A | | 12/1993 | Maglione | |
| 5,513,745 | A | * | 5/1996 | Zoltan et al. | 206/741 |
| 5,540,335 | A | * | 7/1996 | Friedman | 206/756 |
| 5,555,975 | A | * | 9/1996 | Smith | 206/762 |
| 5,630,518 | A | | 5/1997 | Collins | |
| 5,680,941 | A | * | 10/1997 | Smith | 211/133.4 |
| D391,420 | S | * | 3/1998 | Connor et al. | D6/473 |
| 5,758,783 | A | * | 6/1998 | Maglione | 211/126.2 |
| D403,537 | S | * | 1/1999 | Connor et al. | D6/473 |
| 5,868,367 | A | * | 2/1999 | Smith | 248/174 |
| 5,894,933 | A | * | 4/1999 | Crews et al. | 206/750 |
| 5,984,120 | A | * | 11/1999 | Johnske | 211/132.1 |
| 5,988,410 | A | * | 11/1999 | Mandle | 211/133.1 |
| 6,012,582 | A | * | 1/2000 | Haygeman et al. | 206/503 |
| 6,098,820 | A | * | 8/2000 | Smith | 211/132.1 |
| 6,234,433 | B1 | * | 5/2001 | Maglione | 248/174 |
| 6,302,283 | B1 | | 10/2001 | Yeh | |
| 6,474,483 | B1 | * | 11/2002 | Montoya et al. | 211/149 |
| 6,848,371 | B2 | | 2/2005 | Zheng | |
| 6,929,133 | B1 | * | 8/2005 | Knapp et al. | 211/118 |
| 6,966,447 | B2 | | 11/2005 | Hiltke et al. | |
| 7,070,057 | B2 | * | 7/2006 | Moss et al. | 211/132.1 |
| 7,216,772 | B2 | * | 5/2007 | Moss et al. | 211/72 |
| 7,350,648 | B2 | * | 4/2008 | Gerstner et al. | 211/87.01 |
| 7,367,539 | B2 | * | 5/2008 | Moss et al. | 248/460 |
| 7,753,218 | B2 | | 7/2010 | Moss et al. | |
| 7,882,966 | B2 | | 2/2011 | Field et al. | |
| 8,136,678 | B2 | * | 3/2012 | Moss | 211/73 |
| 8,528,751 | B2 | * | 9/2013 | Klein et al. | 211/73 |
| 8,602,500 | B1 | * | 12/2013 | Warren | 297/440.12 |
| 8,826,833 | B1 | * | 9/2014 | Fischer et al. | 108/162 |
| 2004/0011753 | A1 | * | 1/2004 | Field et al. | 211/132.1 |
| 2006/0191172 | A1 | | 8/2006 | Bays | |
| 2006/0273055 | A1 | * | 12/2006 | Moss et al. | 211/135 |
| 2010/0025344 | A1 | * | 2/2010 | Virvo | 211/59.2 |
| 2010/0108623 | A1 | * | 5/2010 | Virvo | 211/49.1 |
| 2012/0248050 | A1 | * | 10/2012 | Heintz | 211/59.2 |

* cited by examiner

MERCHANDISE DISPLAY STAND WITH LOCKING SHELVES

BACKGROUND OF THE INVENTION

This invention relates to merchandise display stands and more particularly display stands made of cardboard, paper board or corrugated paper board and similar materials.

Numerous types of merchandise stands have been developed. Some display stands consist of a merchandise containing case resting horizontally on top of a support stand. Other display stands consist of a merchandise containing case merely resting in a substantially vertical position on a pedestal or shelve provided in front of a vertical stand. In the latter type of display stand, the merchandise case is not securely mounted to the support stand such that it can easily separate or fall off from the stand accidentally. Furthermore, most of the support stands require time consuming assembly and erection and they are awkward to assemble; particularly if a large number of such display stands are to be erected at the same time it would be very time consuming to assemble them.

Conventional display bases are shipped in boxes and transported from the manufacturer to the retailer. In order to save on shipping space and freight charges, they are usually composed of many separate pieces that must be assembled. The retail stores are forced to assemble mismatched displays that crowd their aisles.

The present invention provides easy to erect merchandise stands and trays wherein the stands are formed from a single board and the trays are formed from a single board. This avoids assembly and the need to handle a large number of pieces. Both boards are shipped flat and folded to occupy little shipping space.

SUMMARY OF THE INVENTION

This invention relates to merchandise display stands and more particularly display stands made of cardboard, paper board or corrugated paper board and similar materials. The display stand having a foldable and vertical support portion with merchandise containing cases or trays removably mounted on the support portion and held in place by a dovetail joint formed between the tray and support portion. The display stand may be erected readily at the field location with ease. The merchandise display stand may be used with one or more product display trays.

The support portion of the display stand is formed from single piece of board and is folded and glued together to form a base portion and a back portion. The base and back portions meeting at about a right angle. The back portion further being formed such that it forms the dovetail, male portion, of a dovetail joint. The trays are formed with double thick walls. The top and bottom panels of the trays have a dovetail cut out of a size and shape to accommodate the dovetail back of the support portion of the display stand.

A horizontal fold line is positioned at about the middle position of the stand support portion so that the stand may be folded into a collapsed condition for shipping and storage. One or more large square, rectangular, beveled and lip or tab front merchandise display trays may be mounted to the stand support portion. A plurality and mixture of shapes of merchandise display shelves with said dovetail shaped cut outs may also be mounted to the base support portion.

DETAILED DESCRIPTION OF THE INVENTION

Figure 1:
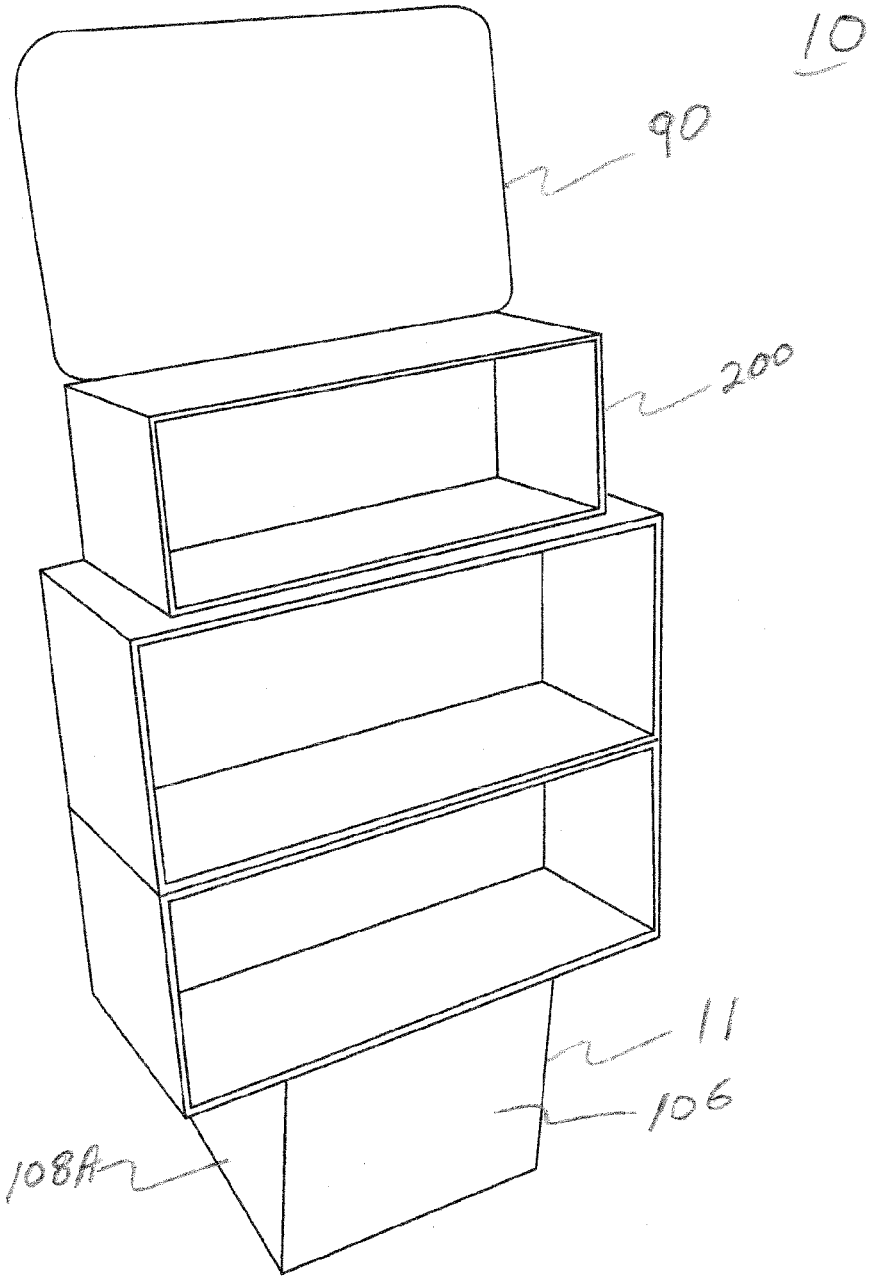
FIG. 1 is a perspective view of the assembled stand with rectangular trays.

The present invention is a display stand having a foldable and upright support portion and base portion in a single unit and formed from a single blank with merchandise containing cases or trays removably mounted on the support portion and the lower most tray sitting on base portion with additional trays sitting on the tray beneath and all trays held in place by a dovetail joint formed between the tray and support portion of the base. The display stand may be erected readily at the field location with ease. The merchandise display stand may be used with one or more product display trays.

The stand support portion is formed from single piece of board and is folded and glued together to form a base portion and a back portion. The base and back portions meeting at about a right angle. The back portion further being formed such that it forms the dovetail, male portion, of a dovetail joint. The trays are formed with double thick walls. Each side wall, top, bottom and back walls having an inner and an outer wall member. The inner and outer back walls of the trays are parallel and separated, that is spaced far enough apart to accommodate the dovetail, male portion, of the back of the support portion. The top and bottom panels of the trays have a dovetail cut out of a size and shape and aligned to accommodate the dovetail back of the support portion of the display stand.

A horizontal fold line is positioned at about the middle position of the stand so that the stand may be folded for shipping and storage. One or more large square, rectangular, beveled and lip or tab front merchandise display trays may be mounted to the stand support portion. Each merchandise display tray having an opposed pair of V-shaped cut outs formed in the back edge of the top and bottom outer panels of the tray at opposite vertically aligned positions so as to accommodate the dovetail, male portion, of the stand support portion. A plurality and mixture of shapes of merchandise display shelves with said V-shaped dovetail openings may also be mounted on to the base support portion. The inventive tray design has no visible raw edges. Sides, top and bottom being formed from double layers of board for added strength.

Preferably, the display stand base is tilted or slanted back with respect to the floor. Typically, the angle between the front panel 103-104 and the base panel 105 will form a about right angle and preferably is a right angle. The front panel 103-104 is preferably perpendicular to the floor or slanted back such that with respect to the floor, the front panel 103-104 would form an angle with respect to the floor beneath the display stand in front of the display stand of about 90° to about 120°.

The stand portion has two trapezoidal side panels, 113A-112A and 113B-112B, that form the sides of the upright support panel. The two trapezoidal side panels form two V-shaped corners with the front panel. A back panel 117-116 joins the side panels to form the upright portion of the stand.

The front panel 103-104 and the trapezoidal side panels 113A-112A and 113B-112B meet to form acute V-shaped corners. The V-shaped corners have the base of the V pointing outwardly from the display stand and form the dovetail, male portion of the display stand support portion.

The definition of board as used herein includes cardboard, paper board or corrugated paper board, foldable plastic sheet, corrugated plastic sheet and similar foldable materials.

Figure 3:
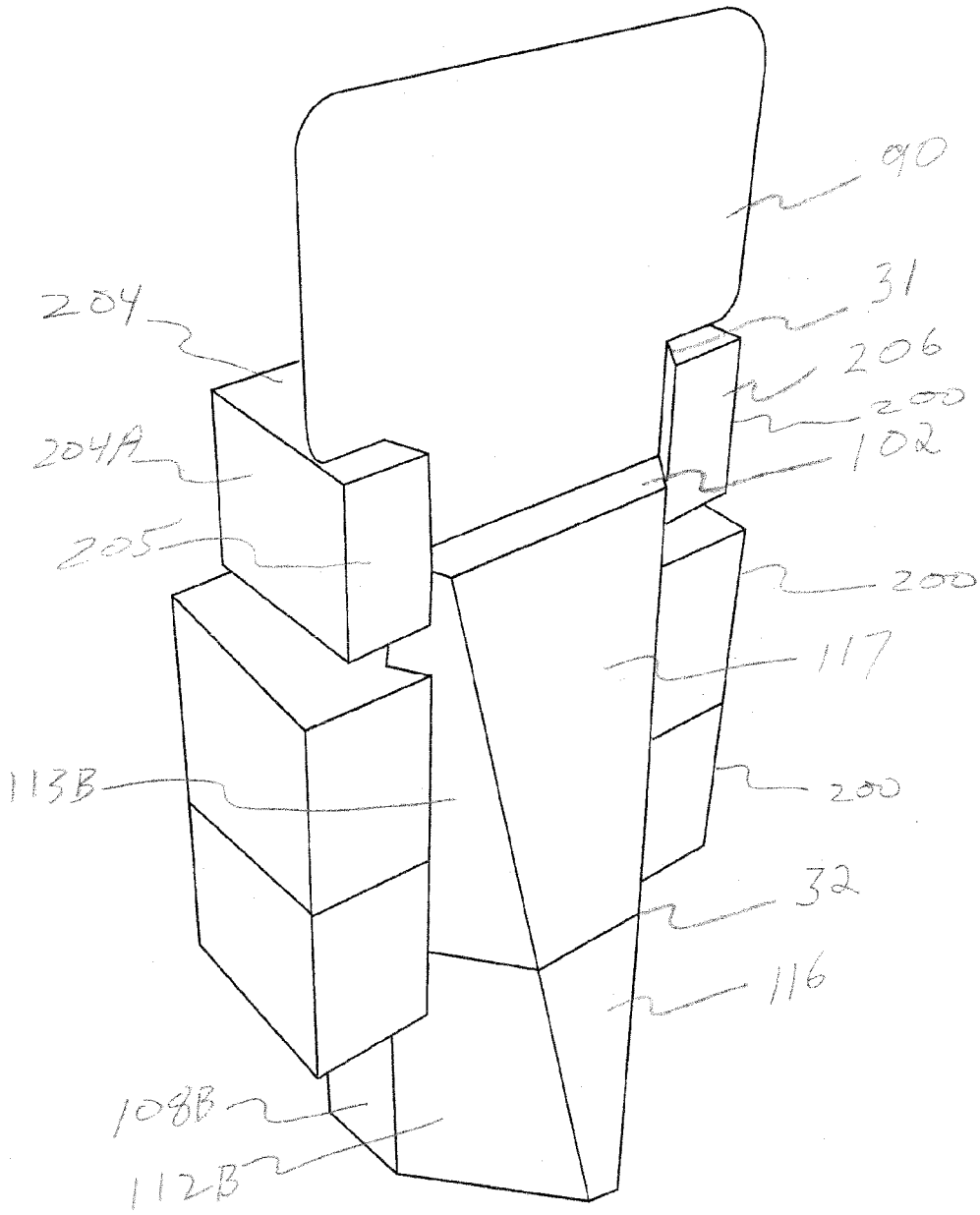
FIG. 3 is a rear perspective view of the assembled stand with rectangular trays.
Figure 6:
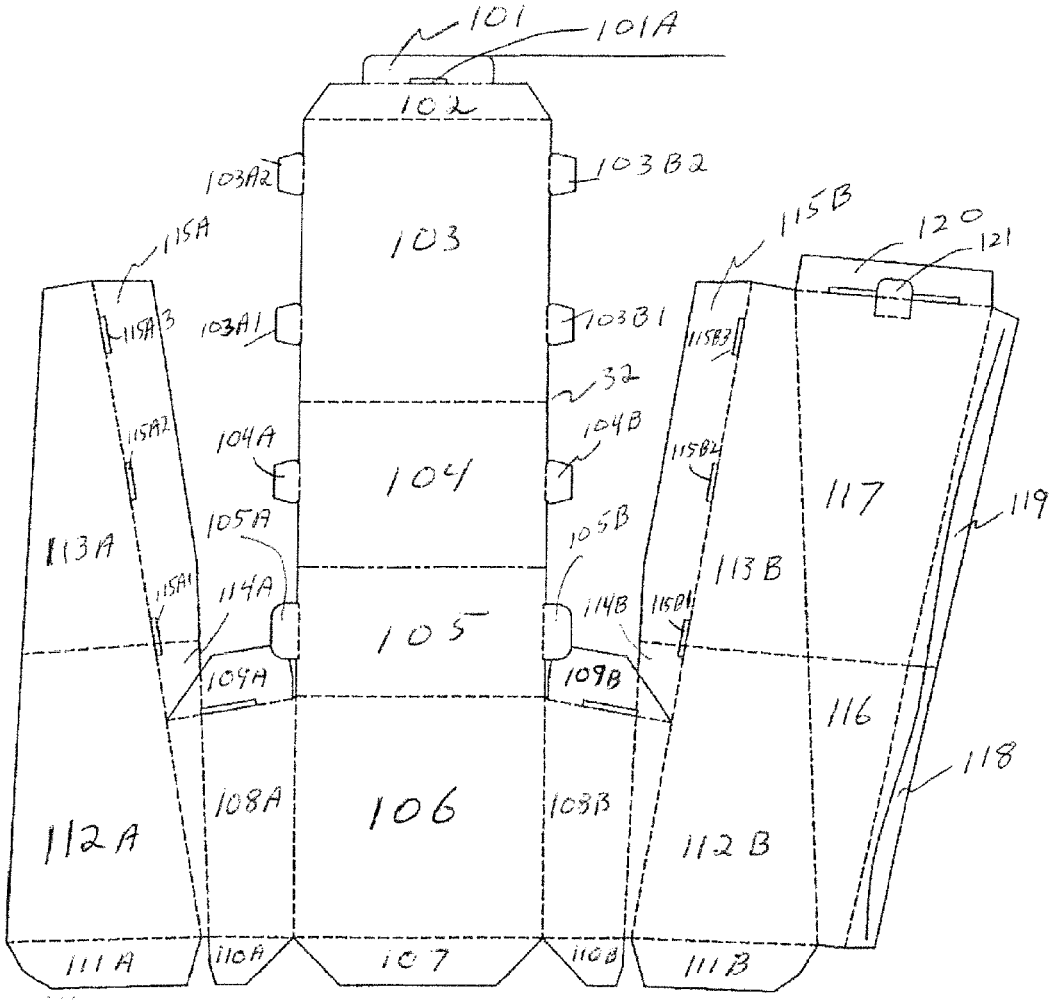
FIG. 6 is a plan view of the blank for the stand support portion.

A horizontal fold line is formed at the middle position of the stand, FIG. 3 and FIG. 6 line 32, so that the stand may be folded for shipping and storing. One or more merchandise display trays may be mounted to the front panel of the erected base. Each merchandise display tray having an opposed pair of V-shaped locking cut outs formed in the back of the top and bottom panels of the merchandise display tray and aligned to facilitate the formation of a dovetail joint with the stand. A plurality of separate merchandise display trays with said V-shaped cut outs may also be mounted to the front panel.

Assembly of the display stand is understood in the below description of the assembly of a preferred embodiment of the invention.

FIG. 1 is a perspective view of the assembled stand with rectangular trays 200. The trays sit on the base 11, front base panel 106 and side base panel 108A of the display stand. Tab 90 is inserted into the top of the stand. Tab 90 is a billboard useful for promoting the displayed product or other promotions or advertising.

Figure 2:
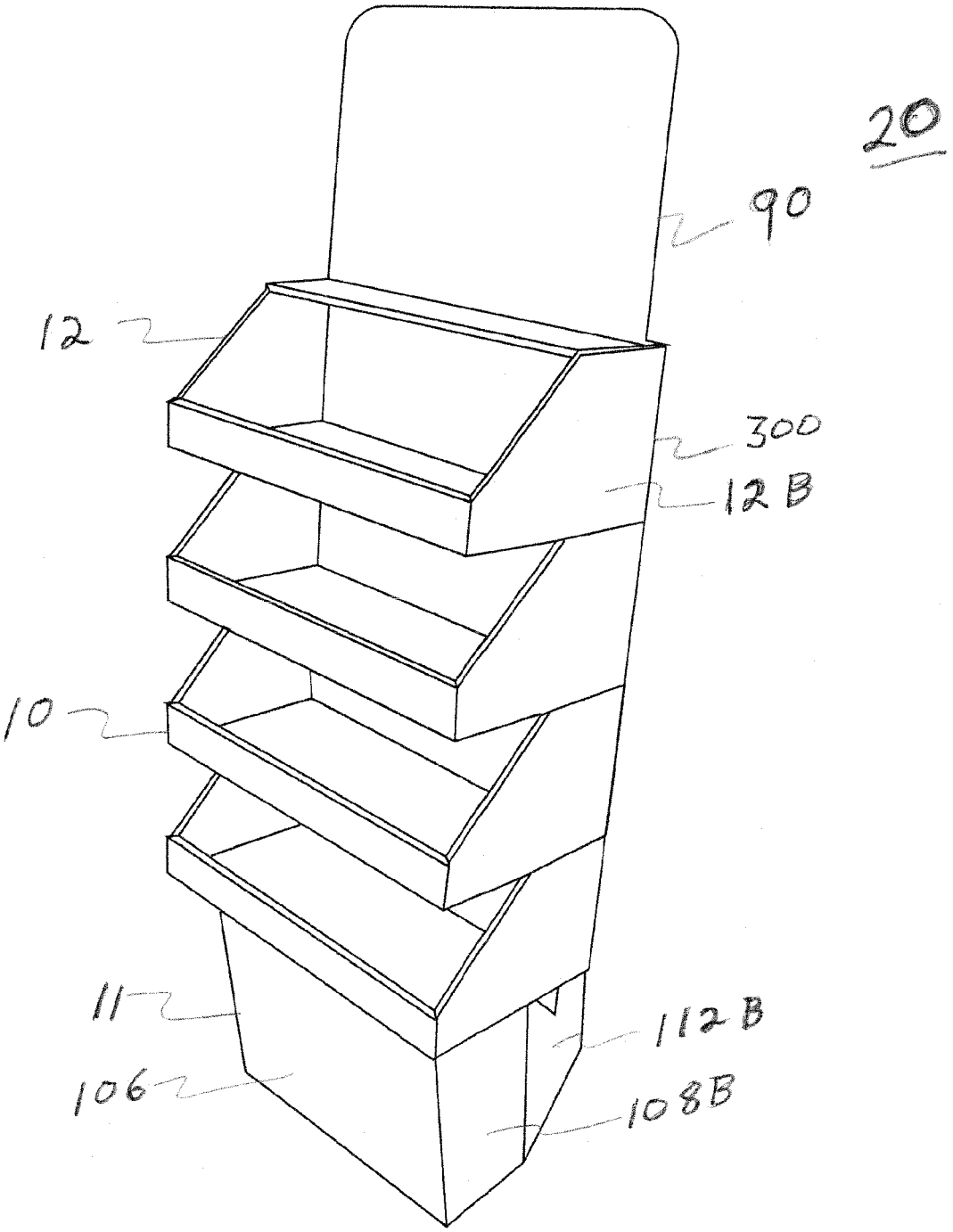
FIG. 2 is a perspective view of the assembled stand with beveled side and lip or tab front rectangular trays.

FIG. 2 is a perspective view of the assembled stand with billboard 90, front base panel 106 and side base panel 108B and back base side panel 112B. Beveled rectangular tray 300 with beveled side 12B, bevel 12 and a lip or tab front 10.

FIG. 3 is a rear perspective view of the assembled stand with 3 rectangular trays 200. Billboard 90 is positioned in the tray dovetail slot 31, which is partially exposed in this expanded view of the display stand, of the top tray between tray top panel 204 and top panel 102 of the dovetail back member of the display stand. Tray 200 back panels 205 and 206 from the back of the dovetail opening in the tray. Display stand back panels 116 and 117 are joined at fold line 32. Fold line 32 facilitates folding the long back panels to allow for compact flat shipping of the stand. Rear panels 113B and 112B also fold along fold line 32.

Figure 4:
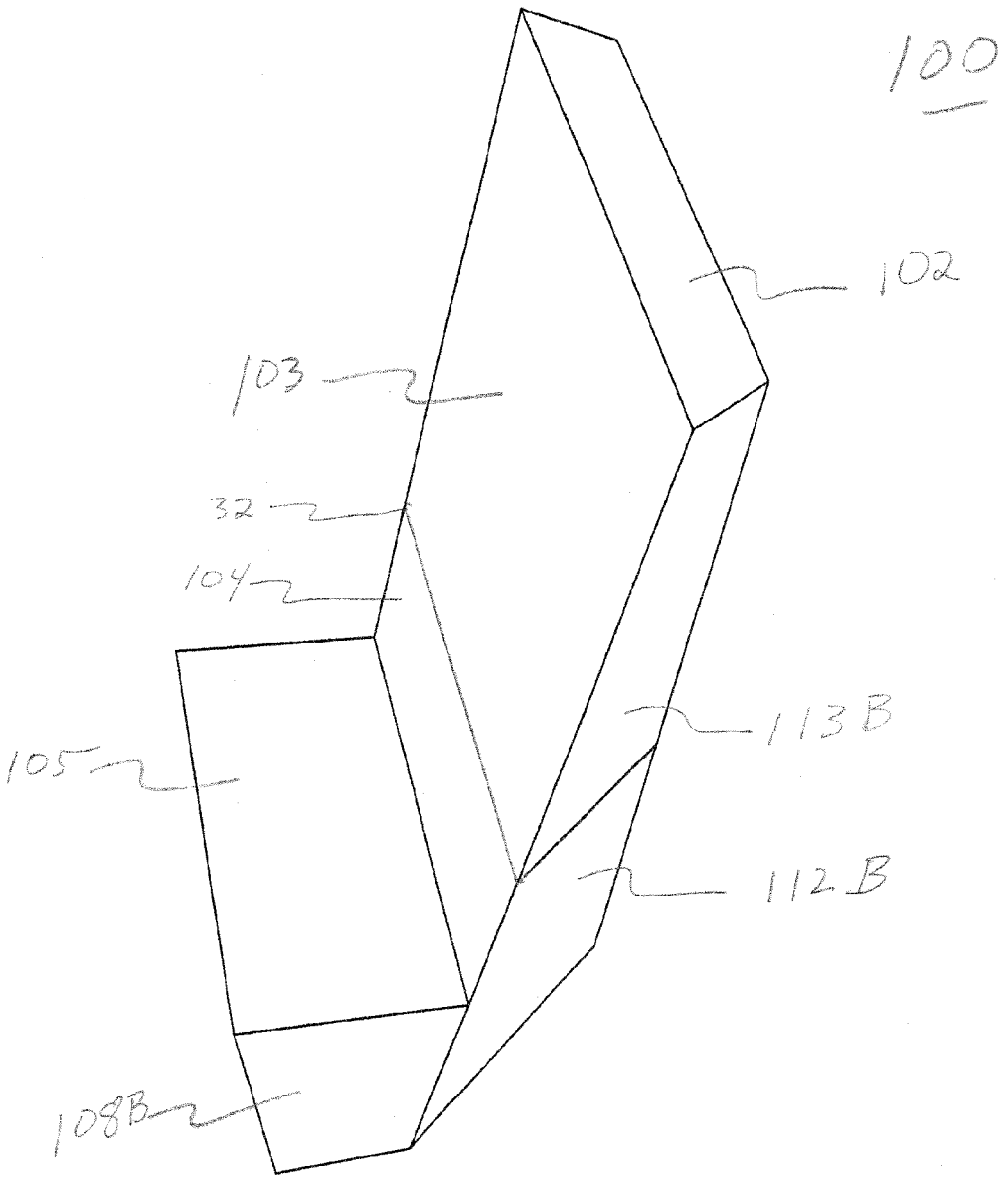
FIG. 4 is a perspective view of the of the stand support portion.

FIG. 4 is a perspective view of the of the stand 100 without trays. The back panel of the display stand is formed by panels 103 and 104 which meet at fold line 32. The angle formed between panels 104 and 105 is preferably about 90 degrees. Panel 105 forms the top of the base support portion of the display stand. The top 102 of the stand forms the top of the dovetail that fits into the dovetail socket or cut out formed in the rear wall of the trays.

Figure 5:
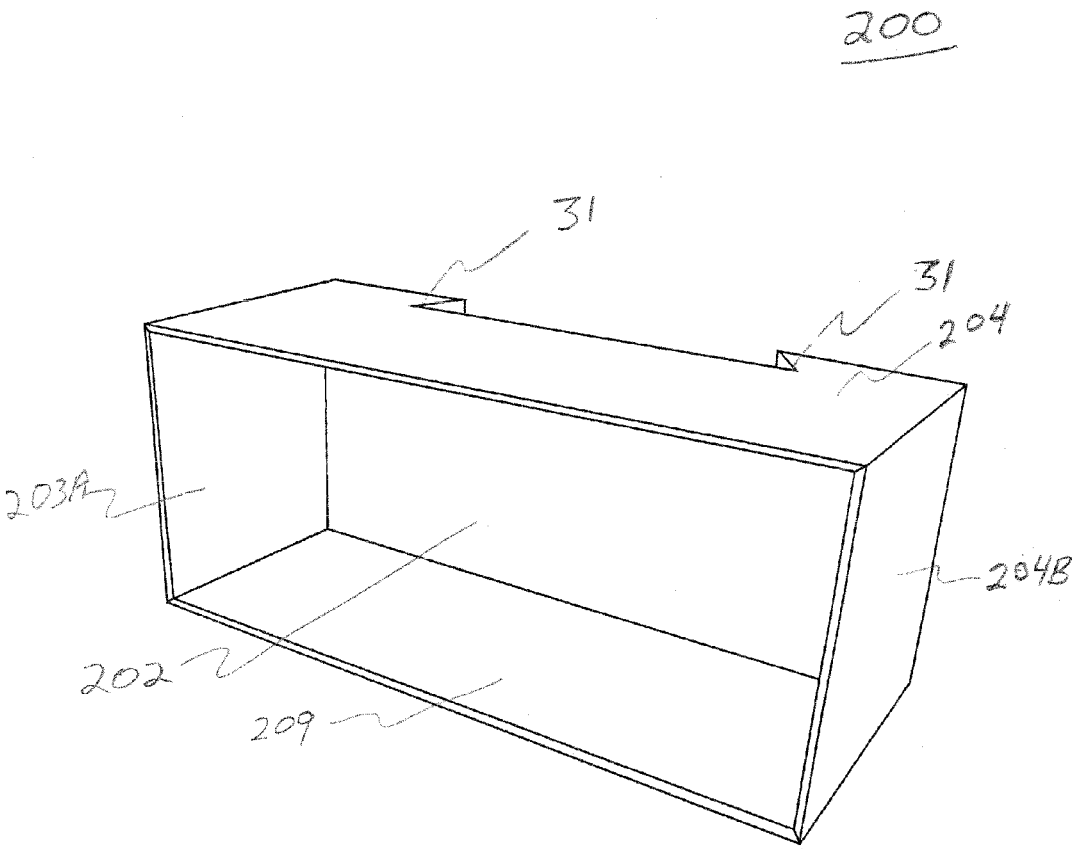
FIG. 5 is a perspective view of a rectangular tray.

FIG. 5 is a perspective view of a rectangular tray. The back of the tray contains the receptacle socket 31 that forms the dovetail joint with the back of the display stand. Receptacle socket 31 is set into top panel 204 and bottom panel 207, not shown, of the tray. The interior back panel 202 of the tray butts against side panel 203A and bottom panel 209 and the other side panel 203B, not shown. The trays of the present invention are three dimensional box like structures.

FIG. 6, Base blank—Base Assembly Instructions

Apply glue to panels (111A, 110A, 107, 110B, and 111B). Fold along their adjacent score line 180 degrees and adhere to panels (112A, 108A, 106, 108B, and 112B), respectively. Fold panels (112B, 113B, 116, and 117) along score line that is adjacent to panel (108B) 180 degrees. Apply glue to panels (118 and 119). Fold panel (112A and 113A) along score line that is adjacent to panel (108A) 180 degrees and adhere to panels (118 and 119). Pull panels (116 and 117) away from panel (106). This will cause the sides of the base (panels 112A, 113A, 108A, 112B, 113B, and 108B) to square into place. Fold panels (109A and 109B) 90 degrees to the inside of the base. Fold panel (105) over to rest onto panels (109A and 109B) making sure to insert tabs (105A and 105B) into slots located on panels (109A and 109B).

Fold panels (115A and 1159B) 90 degrees to the inside of the base. Fold panels (103 and 104) over to rest onto panels (115A and 115B) making sure to insert tabs into the following tab—slot locations: (tab (104A) into slot (115A1))-(tab (104B) into slot (115B1))-(tab (103A1) into slot (115A2))-(tab (103B1) into slot (115B2))-(tab (103A2) into slot (115A3))-(tab (103B2) into slot (115B3)).

Fold panel (120) 90 degrees to the inside of the base. Fold panels (102 and 101) over so that panel (102) rest onto panel (120) and panel (101) inserts into slot on panel (120). Fold tab (121) over and tab into slot (101A).

Figure 7:
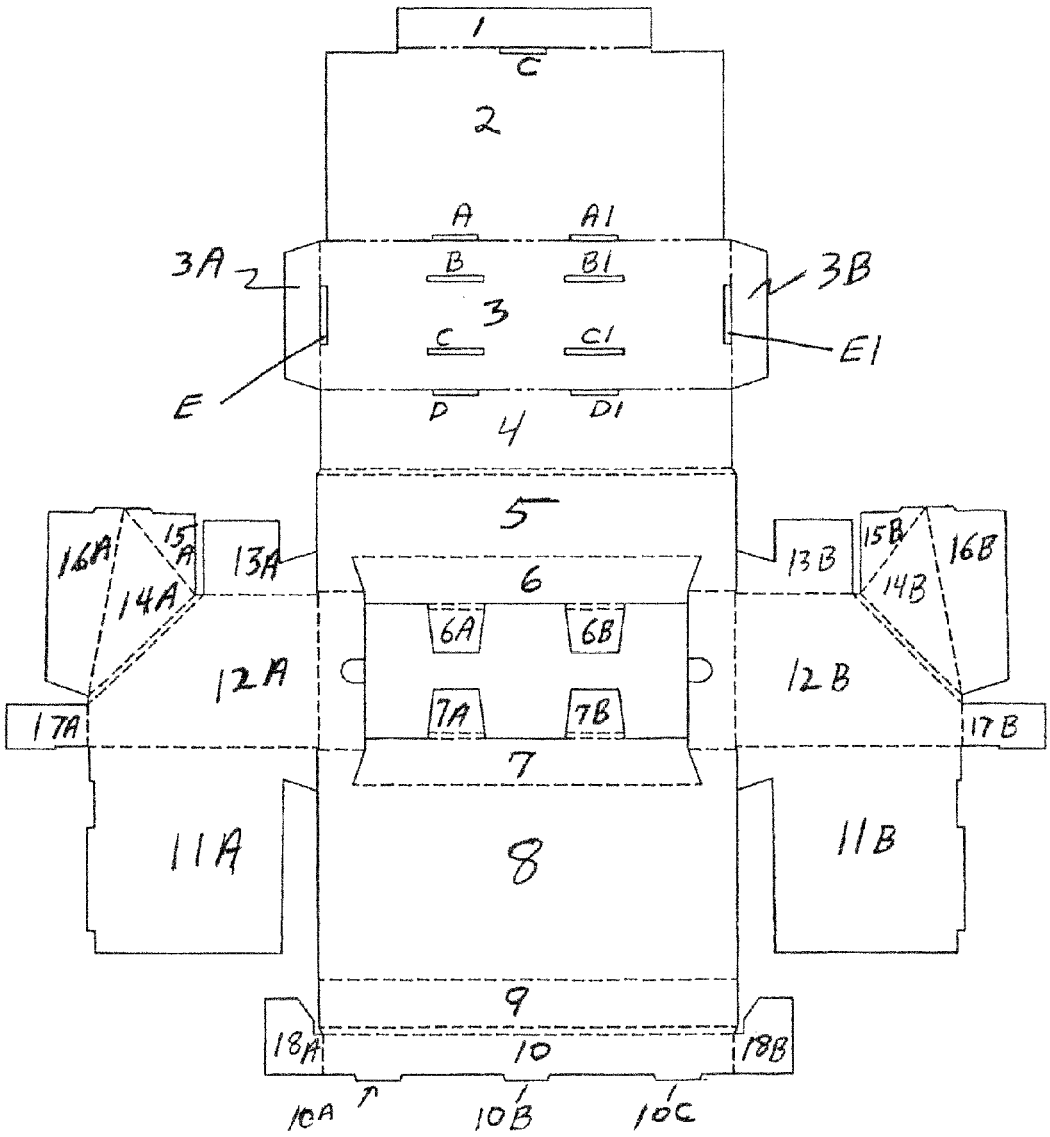
FIG. 7 is a plan view of the blank for a angled side and lip or tab front rectangular tray.

FIG. 7—Tray with beveled sides blank. Assembly instructions for tray with angled sides and front tab. Fold panels (11A and 11B) up 90 degrees. Fold panels (12A and 12B) into tray 90 degrees. Fold panel (8) up 90 degrees to rest on panels (11A and 11B). Fold panels (17A and 17B) into tray 90 degrees.

Fold panels (13A and 13B) into tray 90 degrees. Fold panel (5) up 90 degrees to rest onto panels (13A and 13B). Panels (1, 2, 3, 3A, 3B, and 4) will need to fold simultaneously. Begin by folding panel (1) back 90 degrees. Then, fold panel (2) back 90 degrees. Then, fold panel (3) back 90 degrees. Next, fold panels (3A and 3B) up 90 degrees. Finally, fold panel (4) over panels (13A and 13B). Panel (2) should rest against panel (8) and panel (1) will rest against panel (9).

Fold panel (9) up 90 degrees to rest on panels (17A and 17B). Fold panels (18A and 18B) down 90 degrees. Fold panel (10) over panels (17A and 17B) and lock tabs (10A, 10B, and 10C) into slots on panels (1, 11A, and 11B). Fold panels (14A, 15A, and 16A) into tray locking the tab into slot (E). Fold panels (14B, 15B, and 16B) into tray locking the tab into slot (E1). Fold panel (7) up 90 degrees while inserting panels (7A and 7B) into slots (B and B1). Continue folding panels (7A and 7B) down to tab into slots (A and A1).

Fold panel (6) down 90 degrees while inserting panels (6A and 6B) into slots (C and C1). Continue folding panels (6A and 6B) up to tab into slots (D and D1).

Figure 8:
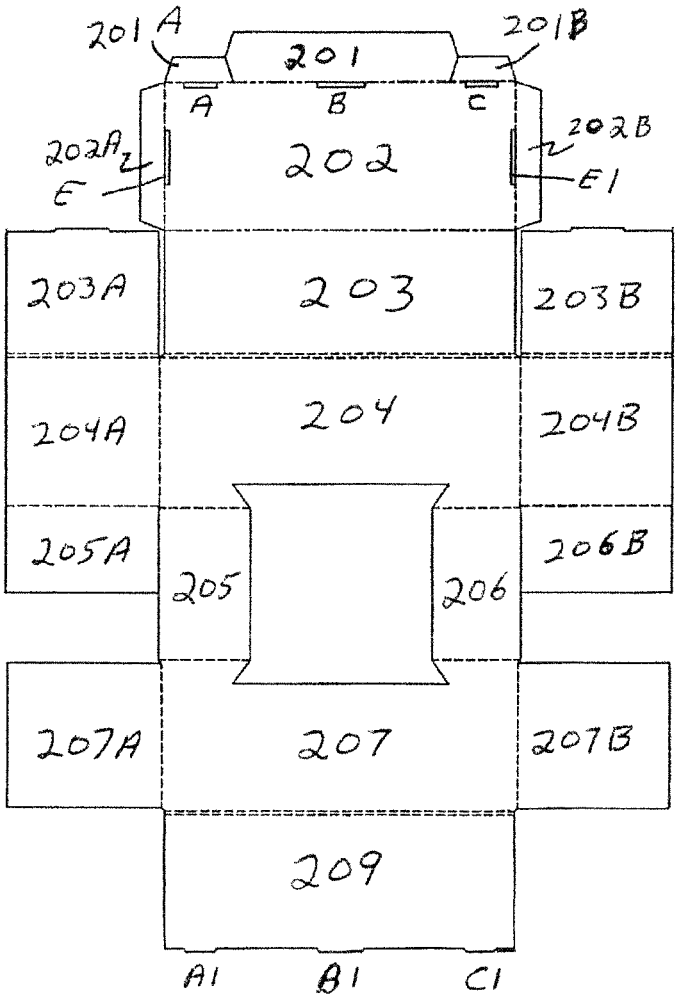
FIG. 8 is a plan view of the blank for a rectangular tray.

FIG. 8—Rectangular three dimensional Tray. Assembly instructions for a rectangular shaped tray.

Fold panels (205, 207, and 209) up 90 degrees. Fold panels (205A and 206B) up 90 degrees. Fold panels (204A and 204B) up 90 degrees. Fold panels (207A and 207B) up 90 degrees. Fold panel (207) 90 degrees, so that panels (207A and 207B) will go inside of tray and rest on panels (204A and 204B). Fold panels (203A and 203B) around panels (207A and 207B). Fold panel (202) back 90 degrees. Fold panels (201A, 201B, 202A, and 202B) up 90 degrees. Fold panel (201) back 90 degrees. Fold panel (203) around to rest against panel (204). Panel (202) will rest parallel with panels (205 and 206), separated by panels (201A, 201B, 202A, and 202B). Fold panel (209) around to rest against panel (207), while inserting tabs (A1, B1, and C1) into slots (A, B, and C).

Figure 9:
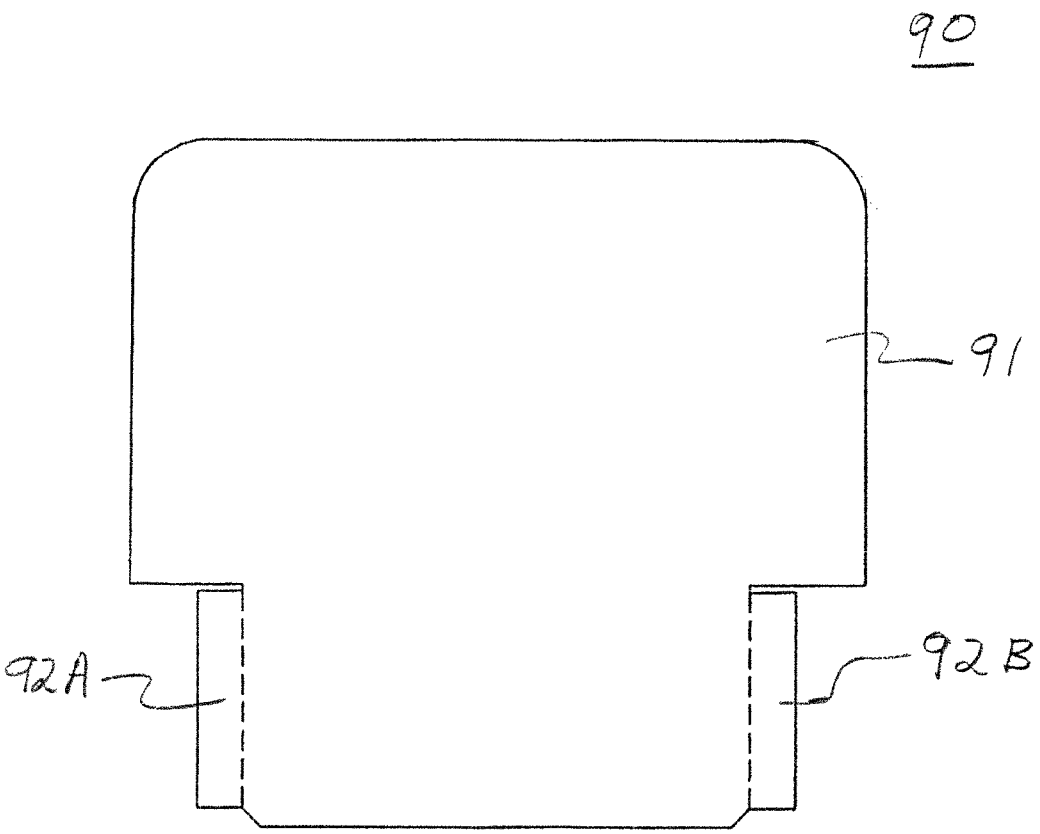
FIG. 9 is a plan view of the blank for a top billboard tab.

FIG. 9 is the top tab or billboard blank. Tabs 92A and 92B are folded forward and the top tab positioned in the dovetail socket of the top most tray prior to the tray being placed on the display stand. Use of the top tab is optional.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined in the appended claims.

I claim:

1. A merchandise display stand for floor display comprising;

a support portion formed of a single board, the support portion having a base member and an upright back member having a front panel and two side panels, said base member having a base panel formed integral with and at about a right angle to the upright back member front panel, said back member forming a male portion of a dovetail joint wherein each of the side panels meets respective edges of the front panel at respective acute angles between said side panels and said front panel; and a plurality of trays arranged on the support portion, each tray having top and bottom panels with corresponding dovetail openings formed therein, wherein said dovetail openings have a reciprocal shape to said male portion of said dovetail joint formed by said back member to accommodate the dovetail male portion of the support portion when each of the trays are lowered into position onto the support portion such that the dovetail male portion fits within the dovetail openings of each tray locking the trays onto the back member.

2. The merchandise display stand of claim 1 wherein the at least one of the plurality of trays is a rectangular box.

3. The merchandise display stand of claim 2 wherein the rectangular box has a front lip and angled side walls.

4. The merchandise display stand of claim 1 wherein at least one of the plurality of trays have no visible raw edges.

5. The merchandise display stand of claim 1 wherein the board is selected from the group consisting of paper, paper board, card board, foldable plastic sheet, corrugated plastic board, or corrugated paper.

6. The merchandise display stand of claim 1 wherein at least one of the trays is formed from a single board.

7. The merchandise display stand of claim 6 wherein the board is corrugated paper board.

8. A merchandise display stand for floor display comprising;

a collapsible support portion made from foldable material, the support portion having an upright back member having a front panel and two side panels, the base member having a base panel being formed integral with the upright back member front panel, said back member forming a male portion of a dovetail joint wherein each of the side panels meets respective edges of the front panel at respective acute angles between said side panels and said front panel; and a plurality of trays arranged on the support portion, each of the trays having top and bottom panels with corresponding dovetail openings formed therein, wherein said dovetail openings have a reciprocal shape to said male portion of said dovetail joint formed by said back member to accommodate the dovetail male portion of the support portion when each of the trays are lowered into position onto the support portion such that the dovetail male portion fits within the dovetail openings of each tray locking the trays onto the back member.

9. The merchandise display stand of claim 8 wherein at least one of the plurality of trays is a rectangular box.

10. The merchandise display stand of claim 9 wherein the rectangular box has a front lip and angled side walls.

11. The merchandise display stand of claim 8 wherein the support portion is formed from a single board.

12. The merchandise display stand of claim 11 wherein the board is selected from the group consisting of paper, foldable plastic sheet, corrugated plastic board, paper board, card board or corrugated paper.

13. The merchandise display stand of claim 8 wherein at least one of the trays is formed from a single board.

14. The merchandise display stand of claim 13 wherein the board is corrugated paper board.

15. The merchandise display stand of claim 8 wherein at least one of the plurality of trays have no visible raw edges.

* * * * *